US005240626A

United States Patent [19]

Thakur et al.

[11] Patent Number: 5,240,626

[45] Date of Patent: Aug. 31, 1993

[54] AQUEOUS FERROFLUID

[75] Inventors: Ranjit Thakur; John S. Roden, both of St. Paul, Minn.

[73] Assignee: Minnesota Mining and Manufacturing Company, St. Paul, Minn.

[21] Appl. No.: 586,507

[22] Filed: Sep. 21, 1990

[51] Int. Cl.[5] ..... H01F 1/00; H01F 1/11

[52] U.S. Cl. ..... 252/62.54; 252/62.51

[58] Field of Search ..... 252/62.51, 62.54

[56] References Cited

U.S. PATENT DOCUMENTS

| | | | |
|---|---|---|---|
| 3,784,471 | 1/1974 | Kaiser | 252/21 |
| 3,795,539 | 3/1974 | DiMino | 252/62.54 |
| 3,916,038 | 10/1975 | Yamaguchi | 252/62.54 |
| 3,951,784 | 4/1976 | Kaiser et al. | 209/1 |
| 3,990,981 | 11/1976 | Kovac et al. | 252/62.54 |
| 4,026,713 | 5/1977 | Sambucetti | 252/62.56 |
| 4,107,063 | 8/1978 | Kovac et al. | 252/62.52 |
| 4,161,454 | 7/1979 | Lu | 252/62.54 |
| 4,208,294 | 6/1980 | Khalafalla et al. | 252/62.52 |
| 4,519,931 | 5/1985 | Soga et al. | 252/62.51 |
| 4,687,596 | 8/1987 | Barduz | 252/62.51 |
| 4,824,587 | 4/1989 | Kwon | 252/62.54 |

FOREIGN PATENT DOCUMENTS

| | | |
|---|---|---|
| 3709851 | 10/1988 | Fed. Rep. of Germany . |
| 3709852 | 10/1988 | Fed. Rep. of Germany . |
| 263204 | 12/1988 | Fed. Rep. of Germany . |
| 263205 | 12/1988 | Fed. Rep. of Germany . |
| 63-210032 | 8/1988 | Japan . |
| 63-239904 | 10/1988 | Japan . |

OTHER PUBLICATIONS

Hawley's Condensed Chemical Dictionary, 11th Ed. pp. 19 and 684, 1987.

Yeh, Ferrofluid Bitter Patterns on Tape, IEEE Trans, on Mag., vol. Mag-16, No. 5, pp. 1650-1652 (Sep. 1980).

Wooding et al., Proteins and Carbohydrates As Alternative Surfactants For The Preparation of Stable Magnetic Fluids, IEEE Trans. on Mag., vol. 24, No. 2, pp. 1650-1652 (Mar. 1988).

Rosenweig, Magnetic Fluids: Phenomena and Process Applications, Chem. Eng. Proc., pp. 53-61 (Apr. 1989).

Rosensweig, *Magnetic Fluids: Phenomena and Process Applications*, Chem. Eng. Proc., p. 54 (Apr. 1989).

Rosensweig, *A Course in Ferrohydrodynamics*, p. II-7 (1980).

Cullity, *Introduction of Magnetic Materials, pp. 386 and 410-418 (1972).*

Morrish, *The Physical Principles of Magnetism*, pp. 360-363 (1980).

Chandrasekhar et al., *Cobalt Ferrite Fluids and Their Application to Magnetic Ink-Jet Printing*, J. of Imaging Technology, vol. 13, No. 2, p. 55 (1987).

Elkafrawy et al., IEEE Trans. on Magnetics, vol. 26, No. 5, (Sep. 1990).

*Primary Examiner*—Prince Willis, Jr.

*Assistant Examiner*—Alan D. Diamond

*Attorney, Agent, or Firm*—Gary L. Griswold; Walter N. Kirn; David B. Kagan

[57] ABSTRACT

An aqueous ferrofluid comprises a plurality of colloidally-dispersed magnetite particles and a dispersing aid. The magnetite particles are coated with an anti-agglomeration agent which is a carboxy-functional polymer.

43 Claims, No Drawings

AQUEOUS FERROFLUID

FIELD OF THE INVENTION

The present invention relates to an aqueous ferrofluid. More specifically, the present invention relates to an aqueous ferrofluid comprising colloidallydispersed magnetite particles that are coated with a carboxy-functional polymer.

BACKGROUND OF THE INVENTION

A ferrofluid is a colloidal suspension of sub-domain magnetic particles in a liquid carrier. The magnetic particles are typically magnetite particles ($Fe_3O_4$) and the like. The magnetic particles are suspended in extremely finely divided form with the help of dispersing aids, anti-agglomeration agents, and the like. The liquid carrier may be aqueous or nonaqueous.

Ferrofluids have many uses, including magnetic domain detection, magnetic adhesives, magnetic paints, lubricants, sealants, ink jet printing, and laser systems. For certain applications, e.g., magnetic domain detection, water is a more desirable liquid carrier than nonaqueous materials. Many aqueous ferrofluids have been proposed. See, e.g., U.S. Pat. Nos. 3,990,981; 4,026,713; and 4,107,063.

There are a number of concerns, however, associated with aqueous ferrofluids. One concern relates to the stability of aqueous ferrofluids. In previously known aqueous ferrofluids, the suspended magnetic particles may tend to precipitate in solution over time. Such precipitation changes the active composition of the ferrofluid. Such ferrofluids also require periodic filtering to remove the precipitate. It would be desirable to prepare an aqueous ferrofluid with improved stability to avoid such unwanted precipitation.

Another concern relates to the use of aqueous ferrofluids for magnetic domain detection. With previously known aqueous ferrofluids, individual bits, individual bytes, bit patterns, magnetic tracks and their straightness, and the like of magnetic recording media cannot be observed with high resolution or good contrast. With the trend towards higher density magnetic recording materials, an aqueous ferrofluid which would allow the magnetic structure and flux patterns of such higher density magnetic recording media to be seen with improved resolution and contrast would be highly desirable.

SUMMARY OF THE INVENTION

The present invention provides an improved aqueous ferrofluid based on a colloidal suspension of magnetite particles which are coated with a carboxyfunctional polymer. The aqueous ferrofluid of the present invention is characterized by excellent stability. Aged samples of the aqueous ferrofluid remain substantially free of any precipitate for extended periods of time, e.g., ten months or more. As a result, the aqueous ferrofluid has a long shelf-life and does not require periodic filtering to remove unwanted precipitate.

As another advantage, the aqueous ferrofluid of the present invention enables optical images of the magnetic structure and flux patterns of magnetic recording media to be formed with excellent resolution and contrast. Preferred embodiments of the invention show an inherent optical resolution of less than 1 micron, which allows individual bits, bytes, tape misalignment effects, burst pattern, tracks and their straightness, and flux patterns to be easily seen using optical viewing devices. Such resolution approaches the best theoretical resolution available with optical viewing devices. Thus, it is believed that the aqueous ferrofluid of the present invention would provide even better resolution by using devices which have better resolution than optical viewing devices, e.g., scanning electron microscopy devices.

The advantages of the present invention are achieved by an aqueous ferrofluid comprising a plurality of colloidally dispersed magnetite particles. The magnetite particles are coated with an anionic anti-agglomeration agent which is a carboxy-functional polymer having a plurality of carboxy groups of the formula $CO_2^-M^+$, wherein $M^+$ is $Na^+$, $Li^+$, $K^+$, $NH_4^+$, or the like. A dispersing aid is used to facilitate the dispersion of the coated magnetite particles in the aqueous ferrofluid. In preferred embodiments of the invention, the dispersing aid comprises a nonionic surfactant and an anionic auxiliary dispersant. The nonionic surfactant is a polyoxyalkylene, an alkylarylpolyether alcohol, an alkylphenol ether, or mixtures thereof. The anionic auxiliary dispersant is a carboxy-functional polymer which may be the same or a different kind of polymer than the carboxy-functional, polymeric anti-agglomeration agent.

In another aspect, the present invention concerns a method of making the improved aqueous ferrofluid composition. An aqueous solution of a ferric salt, a ferrous salt, and the anti-agglomeration agent described above is prepared. A base, e.g., $NH_4OH$, is added to the aqueous solution in order to provide an aqueous suspension of magnetite particles which are coated with the anti-agglomeration agent. The aqueous suspension is then heated. Heating increases the magnetic moment of the magnetite particles by Ostwald ripening. Heating also causes the coated particles to precipitate. The precipitated particles are washed with deionized water. The washed particles are then colloidally dispersed in an aqueous medium comprising a dispersing aid, thereby forming an aqueous ferrofluid of the present invention.

In another aspect, the present invention also concerns a method of using the aqueous ferrofluid to observe the magnetic structure and flux patterns of a magnetic recording medium. The aqueous ferrofluid of the present invention is coated onto the surface of the magnetic recording medium. The ferrofluid is then dried, thereby forming an optical image of the magnetic structure and flux patterns of the magnetic recording medium.

DESCRIPTION OF THE PREFERRED EMBODIMENTS

The aqueous ferrofluids of the present invention comprise a plurality of colloidally-dispersed, magnetite particles ($Fe_3O_4$). Preferably, the magnetite particles of the present invention are characterized by a relatively small particle size and a narrow particle size distribution. For example, magnetite particles useful in the practice of the present invention may have a particle size of from about 20 to about 300 angstroms, preferably from about 20 to about 200 angstroms, and more preferably from about 20 to about 90 angstroms.

In order to prevent the agglomeration of the magnetite particles during precipitation and during dispersion of the particles in an aqueous medium, the magnetite particles of the present invention are coated with an anti-agglomeration agent. Anti-agglomeration agents useful in the practice of the present invention are the various carboxy-functional polymers. The term "carboxy-functional polymer" means a polymer having a plurality of carboxy groups, i.e., $CO_2^-M^+$ groups, wherein $M^+$ is $Na^+$, $Li^+$, $K^+$, $NH_4^+$, or the like. The carboxy groups may be directly pendant from the polymer backbone or may be linked to the polymer backbone via a linking group. Suitable examples of carboxy-functional polymers include polymeric salts based upon acrylic acid; isocrotonic acid, allylacetic acid; fumaric acid; mesaconic acid; maleic acid; citraconic acid; itaconic acid; vinyl acetic acid; methacrylic acid, and the like. The carboxy-functional polymers have excellent electrostatic and steric stabilization properties for dispersing the magnetite particles.

Preferred anti-agglomeration agents of the present invention comprise from about 20 to about 40 percent by weight, and more preferably 27 to 34 percent by weight, of the carboxy groups. A specific example of a particularly preferred carboxy-functional polymer is Tamol-850 commercially available from Rohm & Haas Company. This particular polymer is a carboxyfunctional polymethylmethacrylate comprising a plurality of chain segments of the formula

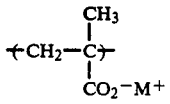

incorporated into the polymer backbone, wherein $M^+$ is $Na^+$. Tamol-850 has a molecular weight of about 30,000 and comprises about 30 percent by weight of carboxy groups. Preferred aqueous ferrofluids of the present invention comprise from about 0.5 grams to about 0.95 grams, and more preferably about 0.8 grams, of Tamol-850 per gram of magnetite.

The coated magnetite particles of the present invention may be prepared by precipitating the magnetite particles in the presence of the carboxy-functional polymer. One example of a preparation technique involves forming an aqueous solution of a ferrous salt, a ferric salt, and the anti-agglomeration agent. The ferrous salt and the ferric salt are used in amounts such that the molar ratio of the $Fe^{3+}$ to the $Fe^{2+}$ is about 1.0. The anti-agglomeration agent is used in an amount such that optimum particle coverage is achieved. Next, a base such as ammonium hydroxide is added to the solution, and an aqueous suspension of the coated magnetite particles is obtained. Typically, the base is added in an amount such that the molar ratio of the $OH^-$ groups to the $Fe^{3+}$ and $Fe^{2+}$ is about 1.8. Preferably, the addition of the base occurs at a temperature of from about 15° C. to about 30° C. and at a pH of about 8. The aqueous suspension is then heated to about 100° C. in order to increase the magnetic moment of the magnetite particles through Ostwald ripening and to precipitate the coated magnetite particles. The theoretical amount of magnetite obtained in the reaction can be calculated from the iron content of the ferrous and ferric salts used to make the magnetite particles. Optionally, the solution may be cooled and the precipitate settled in a magnetic field. The precipitate is then washed with deionized water until the conductivity of the wash water is less than 100 micromhos. Washing removes caustic salts from the particles. If the caustic salts are not removed, the image forming characteristics of the resulting ferrofluid could be adversely affected.

Use of the above-described preparation technique has provided coated magnetite particles ranging in size from about 20 to about 90 angstroms and having a mean particle size of about 40 angstroms with a standard deviation of about +/− 12 angstroms. Advantageously, this preparation technique also provides coated magnetite particles that are colloidally dispersed in the aqueous medium without requiring any milling or grinding steps to achieve such dispersion.

The aqueous ferrofluids of the present invention comprise a dispersing aid to facilitate the dispersion of the coated magnetite particles in the ferrofluid. The dispersing aid may be any of the known anionic, cationic, and/or nonionic surfactants. As one example, a two-component surfactant system is described in U.S. Pat. No. 4,026,713. Generally, the dispersing aid is used to help stabilize the water-based ferrofluid.

Preferably, the dispersing aid comprises a nonionic surfactant and an anionic auxiliary dispersant. The anionic auxiliary dispersant is used to impart an additional negative charge to the magnetite particles, thereby further reducing the tendency of the magnetite particles to agglomerate. The preferred anionic auxiliary dispersant is a carboxy-functional polymer having a plurality of carboxy groups of the formula $CO_2^-M^+$, wherein $M^+$ is $Na^+$, $Li^+$, $K^+$, $NH_4^+$, or the like. Preferred carboxy-functional, polymeric anionic auxiliary dispersants comprise from about 15 to about 35, and more preferably from about 20 to 28 percent by weight of the carboxy groups. Suitable examples of carboxy-functional polymers are salts based upon copolymers of acrylic acid; isocrotonic acid; allylacetic acid; maleic acid; fumaric acid; citraconic acid; itaconic acid; vinyl acetic acid; methacrylic acid and the like that are copolymerized with vinyl systems such as styrene, isoprene, butadiene, vinyl ethers, and the like.

A specific example of an anionic auxiliary dispersant particularly useful in the practice of the present invention is Tamol-731 commercially available from Rohm and Haas. This particular polymer is a carboxy-functional, maleic anhydride copolymer comprising a plurality of chain segments of the formula

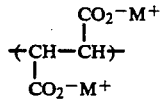

incorporated into the polymer backbone. Tamol-731 has a molecular weight of about 15,000 and comprises about 25 percent by weight of the carboxy groups. Preferred aqueous ferrofluids of the present invention comprise from about 0.05 grams to about 0.3 grams, and more preferably about 0.1 grams, of Tamol-731 per gram of magnetite.

The nonionic surfactant of the present invention provides entropic and hydration properties that are used to provide a bridge between the magnetite particles and the aqueous ferrofluid medium. The nonionic surfactant is used in an amount such that the surface tension of the ferrofluid is from about 27 to about 38 dynes/cm. Examples of suitable nonionic surfactants include polyoxyalkylenes, alkylarylpolyether alcohols, alkylphenol ethers, and the like. Of these materials, a particularly preferred class of nonionic surfactant is an alkylarylpolyether alcohol of the formula

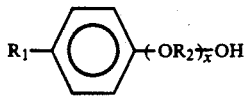

wherein $R_1$ is an alkyl chain having from 6 to 40 carbon atoms, preferably 6 to 25 carbon atoms; $R_2$ is an alkyl chain having from 1 to 4 carbon atoms, preferably 2 carbon atoms; and x is an integer from 10 to 16, preferably 12. A particularly preferred alkylarylpolyether alcohol of this formula is commercially available as Hyonic PE-120 available from Henkel Corporation. Hyonic PE-120 is an alkylarylpolyether alcohol for which $R_1$ is 9, $R_2$ is 2, and x is 12.

Optionally, the aqueous ferrofluid of the present invention may also comprise glycerol and/or a polyether glycol having a molecular weight of about 400 or less. Glycerol may be used in an amount effective to substantially prevent the formation of micelles in the ferrofluid. Practical tests have shown that aqueous ferrofluids including glycerol tend to provide colloidal dispersions of magnetite particles that are more stable over time than aqueous ferrofluids without glycerol. Typically, the aqueous ferrofluids of the present invention comprise from about 0.005 to about 0.04 grams, and more preferably 0.014 grams, of glycerol per gram of magnetite.

The polyether glycol supplements the action of the nonionic surfactant by helping to create a hydration layer that stabilizes the colloidally-dispersed magnetite particles. Examples of suitable polyether glycols include the polyether glycols based upon low molecular weight ethylene glycol, low molecular weight propylene glycol, or lower monoalkyl analogs of such glycols. A particularly preferred polyether glycol is Carbowax commercially available from Union Carbide Company. Carbowax is a polyethylene glycol of the formula $$HO—CH_2—(OCH_2CH_2)_NCH_2OH$$

and has a molecular weight of about 200.

To use the aqueous ferrofluid of the present invention in order to observe the magnetic structure and flux patterns of a particular magnetic recording medium sample, the magnetically written side of the sample is coated with the ferrofluid. The particular technique used to coat the sample is not critical, and a variety of techniques may be used. As one example, the sample may be dipped into the ferrofluid after which excess solution is removed by vertically hanging the sample. Alternatively, a thin layer of the ferrofluid may be applied to the sample using a glass dropper, being careful that the ferrofluid is uniformly spread over the sample. After coating the magnetic side of the sample with the ferrofluid, the ferrofluid is dried, for example, by using compressed air starting on at one end of the sample and progressing toward the other end. A high resolution, optical image of the sample is thereby formed.

When the ferrofluid of the present invention is applied to a particular magnetic recording medium sample, the magnetic field of the medium induces particle density variations in the ferrofluid. The coated magnetite particles tend to consolidate over the bit areas of the medium when the composition is dried. As a result, the particles form surface patterns conforming to the bit areas of the medium. The dried pattern tends to disperse visible light, much like a reflection diffraction grating. This effect allows individual bits, bytes, tracks and their straightness, tape-head misalignment effects, burst patterns, dropouts, and the like to be easily seen.

Optionally, the aqueous ferrofluid of the invention may be used in conjunction with a modifying solution comprising methylcellulose and polyvinyl alcohol. The modifying solution is used to improve the abrasion-resistance, gloss, and bubble-free film forming properties of the ferrofluid. The modifying solution is prepared by dissolving the methylcellulose at a concentration of 0.2 grams per 50 ml and the polyvinyl alcohol at a concentration of 0.2 grams per 50 ml in deionized water. To use the modifying solution, the modifying solution is added to the ferrofluid in a ratio of 1 drop of the modifying solution per 1 to 3 ml of the ferrofluid.

The invention will now be further described with reference to the following examples.

EXAMPLE 1

A modifying solution was prepared by forming a solution of methylcellulose (Methocel E 50P available from Dow Chemical Company) and polyvinyl alcohol (Elvanol 51-05 available from E. I. du Pont de Nemours & Co., Inc.) in deionized water. The concentrations of the methylcellulose and the polyvinyl alcohol were each 0.2 grams per 50 ml of the deionized water.

EXAMPLE 2

A nonionic surfactant solution of alpha(p-nonylphenol)-omega-hydroxypoly(oxyethylene) (a nonionic surfactant available as Hyonic PE-120 from Henkel Corporation) was prepared by dissolving 10 grams of the nonionic surfactant in 50 ml of deionized water.

EXAMPLE 3

Coated magnetite particles of the present invention were prepared as follows. 93.2 grams of ferric nitrate ($Fe_3NO_3.9H_2O$ available from J. T. Baker), 66.3 grams of ferrous sulfate, ($FeSO_4.7H_2O$ available from J. T. Baker) and 1.5 liters of deionized water were combined in a beaker. 30.1 grams of a carboxy-functional polymethylmethacrylate (Tamol-850 available from Rohm & Haas Company) was then added to the solution in small portions under slight agitation. Next, 127 grams of a 58% solution of $NH_4OH$ was added in small portions to the solution under slight agitation. After adding the $NH_4OH$, the color of the mixture changed from reddish-brown to greenish-black. The greenish-black mixture was diluted with 700 ml of deionized water and heated at 95° C. for 45 to 60 minutes. After heating, the mixture was allowed to cool to about room temperature. The cooled mixture was then placed in a magnetic field to settle the coated magnetite particles. The magnetic field was provided by an array of 12 bar magnets arranged in a ring-like fashion around the beaker. The average intergap field was 500 Oe and the tangential field was 360 Oe. After the particles were allowed to settle, about 700 ml of water was decanted. Decanting was stopped when particles appeared in the flow. The particles were then successively rinsed with deionized water by diluting to 2500 ml. Rinsing was repeated until the conductivity of the wash water was less than 100 micromhos. After the final wash, the excess water was decanted. The remaining product was a wet mass of coated particles weighing about 600 grams.

EXAMPLE 4

A magnetic ferrofluid of the present invention was prepared as follows. The wet, coated magnetite particles prepared in Example 3 were added to a solution containing 4.0 grams of a carboxy-functional maleic anhydride copolymer (Tamol-731 available from Rohm & Haas Company), 5.0 grams of the nonionic surfactant solution prepared in Example 2, and 50 ml of deionized water. The wet, coated particles were added at a temperature of about 30° C. to about 35° C. The mixture was vigorously stirred in a Gifford-Wood homomixer for about 1.5 hours. After this, the temperature was raised to about 65° C. to about 70° C., with the addition of a solution containing 0.98 grams of polyethylene glycol (Carbowax available from Union Carbide Company), 0.51 grams of glycerol, and 5 ml of deionized water. The resulting mixture was then digested by heating and stirring at a temperature of from about 65° C. to about 70° C. for 2.5 hours. After cooling the mixture, the mixture was centrifuged four times, each time for 40 minutes at 3500 rpm using an IEC B20A High Speed Centrifuge. The weight of the resulting blackish-brown, aqueous ferrofluid was about 450 grams.

Various physical properties of the resulting ferrofluid were measured. The ferrofluid showed a pH of from about 7 to 8 as measured by a Corning pH meter Model No. 125. The ferrofluid showed a resistivity of 700 to 900 ohms/cm as measured using a YSI Model 31 conductivity bridge. The ferrofluid showed a surface tension of 34 to 35 dynes/cm as measured by a Fischer surface tensiomat model 21.

An image analysis of TEM photomicrographs of the magnetite particles was also made. Based on a count of 932 particles, the analysis showed that the particles ranged in size from 20.0 angstroms to 90.0 angstroms. The mean particle size was 37 angstroms with a standard deviation of ±12 angstroms. The coated particles had a magnetic moment of 29 to 30 emu/g. This measurement was made on air dried particles using a PAR-VSM Model 155 at a maximum field strength of 12.7 kOe.

Other embodiments of this invention will be apparent to those skilled in the art from a consideration of this specification or from practice of the invention disclosed herein. Various omissions, modifications, and changes to the principles described herein may be made by one skilled in the art without departing from the true scope and spirit of the invention which is indicated by the following claims.

What is claimed is:

1. An aqueous ferrofluid, comprising:

(a) a plurality of colloidally-dispersed magnetic particles;

(b) an anionic, anti-agglomeration agent coating the magnetite particles, wherein the anti-agglomeration agent is a carboxy-functional polymer having a plurality of carboxy groups of the formula $CO_2^-$, wherein $M^+$ is selected from the group consisting of $Na^+$, $Li^+$, $K^+$, $NH_4^+$, and mixtures thereof; and (c) a dispersing aid to facilitate dispersion of the coated magnetite particles in the aqueous ferrofluid, wherein the dispersing aid comprises:

(i) an anionic auxiliary dispersant, wherein the anionic auxiliary dispersant is a carboxyfunctional polymer having a plurality of carboxy groups of the formula $CO_2^{-M+}$, wherein $M^+$ is selected from the group consisting of $Na^+$, $Li^+$, $K^+$, $NH_4^+$, and mixtures thereof;

(ii) a nonionic surfactant selected from the group consisting of a polyoxyalkylene, an alkylarylpolyether alcohol, an alkylphenol ether, and mixtures thereof; and (d) an amount of glycerol sufficient to substantially prevent the formation of micelles in the aqueous ferrofluid.

2. The aqueous ferrofluid of claim 1, further comprising a polyether glycol having a molecular weight of about 400 or less, wherein the polyether glycol is present in an amount sufficient to provide hydration effects to help stabilize the colloidal dispersion of magnetite particles.

3. The aqueous ferrofluid of claim 1, wherein the polymeric anti-agglomeration agent comprises a plurality of chain segments having the formula

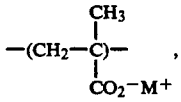

incorporated into the polymer backbone, wherein $M^+$ is $Na^+$.

4. The aqueous ferrofluid of claim 3 wherein the polymeric anti-agglomeration agent is a polymethylmethacrylate having a molecular weight of about 30,000.

5. The aqueous ferrofluid of claim 4 wherein the aqueous ferrofluid comprises from about 0.5 to about 0.95 grams of the polymethylmethacrylate anti-agglomeration agent per gram of the magnetite particles.

6. The aqueous ferrofluid of claim 4, wherein the aqueous ferrofluid comprises about 0.8 grams of the polymethylmethacrylate anti-agglomeration agent per gram of the magnetite particles.

7. The aqueous ferrofluid of claim 1, wherein the polymeric anti-agglomeration agent comprises from about 20 to about 40 percent by weight of the carboxy groups.

8. The aqueous ferrofluid of claim 1, wherein the anionic auxiliary dispersant comprises a plurality of chain segments having the formula

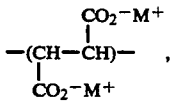

incorporated into the polymer backbone, wherein $M^+$ is selected from the group consisting of $Na^+$, $Li^+$, $K^+$, $NH_4^+$, and mixtures thereof.

9. The aqueous ferrofluid of claim 7, wherein the anionic auxiliary dispersant is a carboxy-functional copolymer having a molecular weight of about 15,000.

10. The aqueous ferrofluid of claim 9, wherein the aqueous ferrofluid comprises from about 0.05 to about 0.3 grams of the carboxy-functional copolymer per gram of the magnetite particles.

11. The aqueous ferrofluid of claim 9, wherein the aqueous ferrofluid composition comprises about 0.1 grams of the carboxy-functional copolymer per gram of the magnetite particles.

12. The aqueous ferrofluid of claim 1, wherein the anionic auxiliary dispersant comprises from about 15 to about 35 percent by weight of the carboxy groups.

13. The aqueous ferrofluid of claim 1, wherein the non-ionic surfactant has the formula

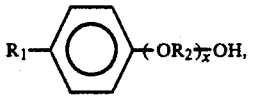

14. The aqueous ferrofluid of claim 13, wherein x is 12; $R_1$ is an alkyl chain having 9 carbon atoms; and $R_2$ is an alkyl chain having 2 carbon atoms.

15. The aqueous ferrofluid of claim 14 wherein the aqueous ferrofluid comprises from about 0.008 to about 0.05 grams of the nonionic surfactant per gram of the magnetite particles.

16. The aqueous ferrofluid of claim 14, wherein the aqueous ferrofluid comprises about 0.02 grams of the nonionic surfactant per gram of the magnetite particles.

17. The aqueous ferrofluid of claim 1, wherein the aqueous ferrofluid comprises from about 0.005 to about 0.04 grams of the glycerol per gram of the magnetite particles.

18. The aqueous ferrofluid of claim 1, wherein aqueous ferrofluid comprises about 0.014 grams of glycerol per gram of the magnetite particles.

19. The aqueous ferrofluid of claim 2 wherein the polyether glycol is selected from the group consisting of low molecular weight ethylene glycol; low molecular weight propylene glycol; and lower monoalkyl analogs of such glycols.

20. The aqueous ferrofluid of claim 2, wherein the polyether glycol has the formula $$HO—CH_2—(OCH_2\,CH_2)_N\,CH_2\,OH$$

and has a molecular weight of about 200 wherein N is 3.

21. The aqueous ferrofluid of claim 20, wherein the aqueous ferrofluid comprises from about 0.01 to about 0.05 grams of the polyether glycol per gram of the magnetite particles.

22. The aqueous ferrofluid of claim 20, wherein the aqueous ferrofluid comprises about 0.03 grams of the polyether glycol per gram of the magnetite particles.

23. An aqueous ferrofluid, comprising:

(a) a plurality of colloidally-dispersed magnetite particles;

(b) an anionic, anti-agglomeration agent coating the magnitude particles, wherein the anti-agglomeration agent is a carboxy-functional polymer having a plurality of carboxy groups of the formula $CO_2-^{M}+$, wherein $M^+$ is selected from the group consisting of $Na^+$, $Li^+$, $K^+$, $NH_4^+$, and mixtures thereof;

(c) a dispersing aid to facilitate dispersion of the coated magnetite particles in the aqueous ferrofluid wherein the dispersing aid comprises:

(i) an anionic auxiliary dispersant, wherein the anionic auxiliary dispersant is a carboxyfunctional polymer having a plurality of carboxy groups of the formula $CO_2-M^+$, wherein $M^+$ is selected from the group consisting of $Na^+$, $Li^+$, $K^+$, $NH_4^+$, and mixtures thereof; and (ii) of a nonionic surfactant selected from the group consisting of a polyoxyalkylene, an alkylarylpolyether alcohol, an alkylphenol ether, and mixtures thereof (d) from about 0.005 to about 0.04 grams of glycerol per gram of the magnetite particles; and (e) a polyether glycol having a molecular weight of about 400 or less, wherein the polyether glycol is present in an amount of from about 0.01 to about 0.05 grams per gram of the magnetite particles.

24. A method of making an aqueous ferrofluid, comprising the steps of:

(a) preparing an aqueous solution which comprises a ferric salt, a ferrous salt, and an antiagglomeration agent, wherein the anti-agglomeration agent is a carboxy-functional polymer having a plurality of carboxy groups of the formula $CO_2$-$M^+$, wherein $M^+$ is selected from the group consisting of $Na^+$, $Li^+$, $K^+$, $NH_4+$, and mixtures thereof;

(b) adding a base to the aqueous solution to yield an aqueous suspension of magnetite particles which are coated with the anti-agglomeration agent;

(c) heating the aqueous suspension to cause the coated magnetite particles to precipitate;

(d) cooling the precipitate-containing solution resulting from step (c);

(e) settling the precipitated particles in a magnetic field;

(f) washing the precipitated particles with deionized water;

(g) colloidally dispersing the washed particles in an aqueous medium which comprises a dispersing aid, thereby providing an aqueous ferrofluid, wherein the dispersing aid comprises:

(1) an anionic auxiliary dispersant, wherein the anionic auxiliary dispersant is a carboxy-functional polymer having a plurality of carboxy groups of the formula $CO_2-M^+$, wherein M is selected from the group consisting of $Na^+$, $Li^+$, $K^+$, $NH_4+$, and mixtures thereof; and (2) a nonionic surfactant selected from the group consisting of polyoxyalkylenes, alkylarylpolyether alcohols, alkylphenol ethers, and mixtures thereof.

25. The method of claim 24, wherein the molar ratio of $Fe^{3+}$ to $Fe^{2+}$ in step (a) is about 1.0.

26. The method of claim 24 wherein the molar ratio of $OH^-$ added in step (b) to the total moles of $Fe^{3+}$ and $Fe^{2+}$ is about 1.8.

27. The method of claim 24 wherein the base is $NH_4OH$.

28. The method of claim 24, wherein step (b) occurs at a temperature of about 25° C.

29. The method of claim 24, wherein step (c) occurs at a temperature of about 90° C. to about 100° C.

30. The method of claim 24, further comprising the step of combining the aqueous ferrofluid resulting from step (e) with an aqueous modifying solution, wherein:

(a) the aqueous modifying solution comprises 0.2 grams of methylcellulose per ml and 0.2 grams of polyvinyl alcohol per ml; and (b) the modifying solution is combined with the ferrofluid in a ratio of 1 drop of modifying solution per 1 to 3 ml of the aqueous ferrofluid.

31. The method of claim 24, wherein the polymeric anti-agglomeration agent comprises a plurality of chain segments having the formula

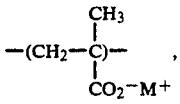

incorporated into the polymer backbone, wherein $M^+$ is selected from the group consisting of $Na^+$, $K^+$, $Li^+$, $NH_4^+$, and mixtures thereof.

32. The method of claim 31, wherein the polymeric anti-agglomeration agent is a polymethylmethacrylate having a molecular weight of about 30,000.

33. The method of claim 24, wherein the polymeric anti-agglomeration agent comprises from about 20 to about 40 percent by weight of the carboxy groups.

34. The method of claim 24, wherein the anionic auxiliary dispersant comprises a plurality of chain segments having the formula

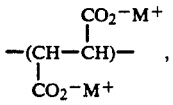

incorporated into the polymer backbone, wherein $M^+$ is selected from the group consisting of $Na^+$, $Li^+$, $K^+$, $NH_4^+$, and mixtures thereof.

35. The method of claim 34, wherein the anionic auxiliary dispersant is a carboxy-functional copolymer having a molecular weight of about 15,000.

36. The method of claim 24, wherein the anionic auxiliary dispersant comprises from about 15 to about 35 percent by weight of the carboxy groups.

37. The method of claim 24, wherein the non-ionic surfactant has the formula

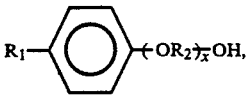

wherein $R_1$ is an alkyl chain having from 6 to 40 carbon atoms; $R_2$ is an alkyl chain of from 1 to 4 carbon atoms; and x is an integer from 10 to 16.

38. The method of claim 37 wherein x is 12; $R_1$ is an alkyl chain having 9 carbon atoms; and $R_2$ is an alkyl chain having 2 carbon atoms.

39. The method of claim 24, wherein step (e) comprises the steps of (1) mixing the aqueous medium, the dispersing aid, and the washed particles;

(2) combining a glycol-glycerol solution with the mixture resulting from step (1), wherein the glycol-glycerol solution comprises a polyether glycol, glycerol, and deionized water;

(3) digesting the mixture resulting from step (2); and (4) centrifuging the mixture resulting from step (3).

40. The method of claim 39 wherein step (1) occurs for about 1.5 hours.

41. The method of claim 39, wherein step (2) occurs at a temperature of from about 65° C. to about 70° C.

42. The method of claim 39, wherein step (3) occurs at a temperature of from about 65° C. to about 70° C. for about 2.5 hours.

43. A method of observing the magnetic structure of a magnetic recording medium, comprising the steps of:

(a) coating the surface of the magnetic recording medium with the aqueous ferrofluid of claim 1;

(b) drying the aqueous ferrofluid composition to thereby form an optical image of the magnetic domains of the magnetic recording medium.

* * * * *

UNITED STATES PATENT AND TRADEMARK OFFICE

CERTIFICATE OF CORRECTION

PATENT NO. : 5,240,626

DATED : August 31, 1993

INVENTOR(S) : Thakur et al.

It is certified that error appears in the above-indentified patent and that said Letters Patent is hereby corrected as shown below:

Col. 1, line 7, "colloidallydispersed" should be --colloidally-dispersed--.

Col. 7, line 58, "$CO_2$-" should be --$CO_2^-M^+$--.

Col. 7, line 68, "CO2-$^M$+" should be --$CO_2^-M^+$--.

Col. 9, line 11, after the formula in claim 3, insert:

--wherein $R_1$ is an alkyl chain having from 6 to 40 carbon atoms; $R_2$ is an alkyl chain of from 1 to 4 carbon atoms; and x is an integer from 10 to 16.--

Col. 9, line 52, "magnitude" should be --magnetite--.

Col. 9, line 55, "$CO_2$-$^M$+" should be --$CO_2^-M^+$--.

Col. 9, lines 62/63, "carboxyfunc-" should be --carboxy-func---.

Col. 9, line 67, "(ii) of a" should be --(ii) a--.

UNITED STATES PATENT AND TRADEMARK OFFICE

CERTIFICATE OF CORRECTION

PATENT NO. : 5,240,626

DATED : August 31, 1993

INVENTOR(S) : Thakur et al

It is certified that error appears in the above-indentified patent and that said Letters Patent is hereby corrected as shown below:

Col. 10, line 13, "antiagglomeration" should be --anti-agglomeration--.

Signed and Sealed this

Nineteenth Day of July, 1994

Bruce Lehman

*Attest:*

BRUCE LEHMAN

*Attesting Officer*

*Commissioner of Patents and Trademarks*